US009495906B2

(12) United States Patent
Ishii et al.

(10) Patent No.: US 9,495,906 B2
(45) Date of Patent: Nov. 15, 2016

(54) PIXEL CIRCUIT FOR DISPLAYING GRADATION WITH ACCURACY AND DISPLAY DEVICE USING THE SAME

(71) Applicant: SAMSUNG DISPLAY CO., LTD., Yongin, Gyeonggi-Do (KR)

(72) Inventors: Ryo Ishii, Yokohama (JP); Daisuke Kawae, Yokohama (JP); Masayuki Kumeta, Yokohama (JP); Naoaki Komiya, Yokohama (JP)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 219 days.

(21) Appl. No.: 14/103,037

(22) Filed: Dec. 11, 2013

(65) Prior Publication Data

US 2014/0160179 A1 Jun. 12, 2014

(30) Foreign Application Priority Data

Dec. 11, 2012 (JP) ..... 2012-270717

(51) Int. Cl.
*G09G 5/10* (2006.01)
*G09G 3/32* (2016.01)

(52) U.S. Cl.
CPC .... *G09G 3/3233* (2013.01); *G09G 2300/0819* (2013.01); *G09G 2310/0262* (2013.01)

(58) Field of Classification Search
CPC ..... G09G 3/3233; G09G 2310/0262; G09G 2300/0819
USPC ..... 345/690, 77
See application file for complete search history.

(56) References Cited

U.S. PATENT DOCUMENTS

| | | | | |
|---|---|---|---|---|
| 7,724,245 | B2 * | 5/2010 | Miyazawa | G09G 3/3233 345/204 |
| 2004/0004443 | A1 * | 1/2004 | Park | G09G 3/3233 315/169.1 |
| 2006/0044235 | A1 * | 3/2006 | Lee | G09G 3/3233 345/82 |
| 2007/0164938 | A1 * | 7/2007 | Shin | G09G 3/3233 345/76 |
| 2011/0227889 | A1 * | 9/2011 | Choi | G09G 3/3233 345/209 |
| 2011/0227904 | A1 * | 9/2011 | Choi | G09G 3/3233 345/212 |

FOREIGN PATENT DOCUMENTS

| | | |
|---|---|---|
| JP | 2006-018301 | 1/2006 |
| JP | 2009-128870 | 6/2009 |
| JP | 2010-266848 | 11/2010 |

* cited by examiner

*Primary Examiner* — Kwang-Su Yang
(74) *Attorney, Agent, or Firm* — Lee & Morse P.C.

(57) ABSTRACT

A pixel circuit is provided which includes a light-emitting element; a driving transistor configured to control an amount of current supplied from a first power line to the light-emitting element according to a pixel voltage; a capacitor having one end connected to a second power line and the other end connected to a gate of the driving transistor and configured to hold the pixel voltage; a first switch transistor configured to selectively switch the pixel voltage provided through a data signal line into the capacitor; and a second switch transistor configured to selectively connect the first power line and the second power line. The first and second power lines are separated during a period where the capacitor is charged by the pixel voltage, and are shorted during a period where the driving transistor operates according to the pixel voltage.

20 Claims, 8 Drawing Sheets

PIXEL CIRCUIT FOR DISPLAYING GRADATION WITH ACCURACY AND DISPLAY DEVICE USING THE SAME

CROSS-REFERENCE TO RELATED APPLICATION

Japanese Patent Application No. 2012-270717, filed on Dec. 11, 2012, and entitled "PIXEL CIRCUIT AND DISPLAY DEVICE," is incorporated by reference herein in its entirety.

BACKGROUND

1. Field

One or more embodiments described herein relate to a display device.

2. Description of the Related Art

One type of display device known as an organic light emitting display device has pixel circuits for controlling light-emitting states of pixels arranged in a lattice structure. One approach for improving resolution of such a device is to increase the number of pixels. However, improving resolution in this manner may cause problems. For example, the widths of interconnections and the size of pixels and other elements of the display are scaled down. As a result, a luminance difference may be generated between pixels. Various methods have been used to address these drawbacks. However, they have proven inadequate.

SUMMARY

In accordance with one embodiment, a pixel circuit including a light-emitting element; a driving transistor to control an amount of current supplied from a first power line to the light-emitting element according to a pixel voltage; a capacitor to hold the pixel voltage, the capacitor having one end connected to a second power line and another end connected to a gate of the driving transistor; a first switch transistor to selectively switch the pixel voltage provided through a data signal line to the capacitor; and a second switch transistor to selectively connect the first power line and the second power line, wherein the first and second switch transistors are turned on at different times which do not overlap one another.

Voltages transferred through the first and second power lines may have substantially a same voltage value.

The pixel circuit may include a voltage generator to generate the voltages transferred through the first and second power lines. The first and second power lines may intersect one another. The first switch transistor may be connected between the data signal line and the gate of the driving transistor.

The pixel circuit may include a third switch transistor controlled by a same control signal as the first switch transistor, the third switch transistor connected between the gate and a drain of the driving transistor; an emission transistor controlled by a same control signal as the second switch transistor, the emission transistor connected between the drain of the driving transistor and the light-emitting element; a fourth switch transistor controlled by a same control signal as the second switch transistor, the fourth switch transistor connected between a source of the driving transistor and the second power line; and a fifth switch transistor to provide the capacitor with an initialization voltage during a period before when the pixel voltage is supplied to the capacitor by the first switch transistor, wherein the first switch transistor is connected between the data signal line and the source of the driving transistor.

In accordance with another embodiment, a display device includes a plurality of pixel circuits arranged in a lattice shape; and a control circuit to control the plurality of pixel circuits, wherein each of the plurality of pixel circuits includes: a light-emitting element; a driving transistor to control an amount of current supplied from a first power line to the light-emitting element according to a pixel voltage; a capacitor to hold the pixel voltage, the capacitor having one end connected to a second power line and another end connected to a gate of the driving transistor; a first switch transistor to selectively switch the pixel voltage provided through a data signal line to the capacitor; and a second switch transistor to selectively connect the first power line and the second power line, wherein the control circuit is further configured to turn on the first and second switch transistors at different times which do not overlap one another.

Voltages transferred through the first and second power lines may have substantially a same voltage value. The pixel circuit may include a voltage generator to generate the voltages transferred through the first and second power lines. The first and second power lines may intersect one another. The first switch transistor may be connected between the data signal line and the gate of the driving transistor.

Each of the plurality of pixel circuits may include: a third switch transistor controlled by a same control signal as the first switch transistor, the third switch transistor connected between the gate and a drain of the driving transistor; an emission transistor controlled by a same control signal as the second switch transistor, the emission transistor connected between the drain of the driving transistor and the light-emitting element; a fourth switch transistor controlled by a same control signal as the second switch transistor, the fourth switch transistor connected between a source of the driving transistor and the second power line; and a fifth switch transistor to provide the capacitor with an initialization voltage during a period before when the pixel voltage is supplied to the capacitor by the first switch transistor, wherein the first switch transistor is connected between the data signal line and the source of the driving transistor.

In accordance with another embodiment, a pixel circuit includes a capacitor to store a data voltage; a driving transistor coupled to the capacitor; and a light-emitting element coupled to the driving transistor, wherein the capacitor is coupled to a second power supply and a data line during a first period and the light-emitting element is coupled to a signal path which couples the second power supply to the first power supply during a second period, and wherein the signal path is coupled to the light-emitting element through the driving transistor during the second period.

The first and second power supplies may supply substantially a same voltage. A data update operation may be performed during the first period, and a light-emitting operation may be performed during the second period. The second power supply may not be coupled to the light-emitting element during the first period.

A gate voltage of the driving transistor may be substantially equal to the data voltage stored in the capacitor during the second period based on supply of voltage from the second power supply.

The second power supply may be prevented from being coupled to the light-emitting element by a first scan signal; and the second power supply line may be coupled to the first power supply line through the signal path by a second scan signal complementary to the first scan signal.

The pixel circuit may include a first switch coupled to the signal path between the first and second power supply lines; and a second switch coupled between a data line and a node of the capacitor, wherein the first and second switches have different on/off states during the first and second periods. The pixel circuit may also include a first line coupled to the first power supply and a second line coupled to the second power supply, wherein the first and second lines are oriented in different directions that cross one another.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
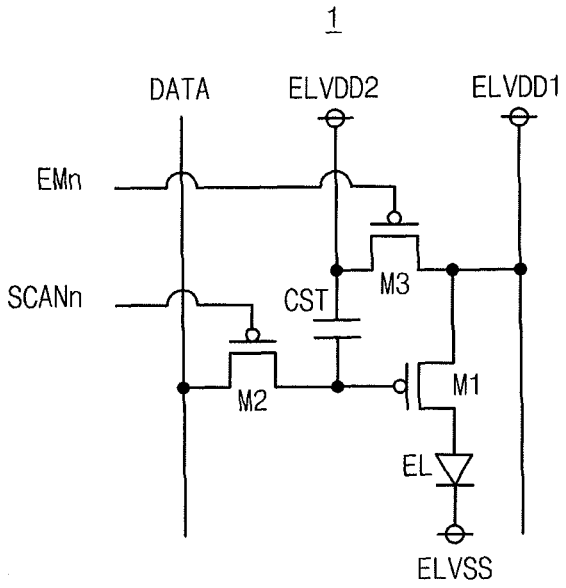
FIG. 1 illustrates an embodiment of a pixel circuit.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

The following embodiments of pixel circuits may be included in a display device such as an organic light-emitting display device. Also, some of the embodiments of the pixel circuit are implemented by PMOS transistors, these pixel circuits may alternatively be implemented by NMOS transistors.

FIG. 1 illustrates an embodiment of a pixel circuit 1 which includes a light-emitting element EL (EL), a driving transistor M1, a storage capacitor CST, a first switch transistor M2, and a second switch transistor M3.

The light-emitting element EL may be a light-emitting diode, for example. The light-emitting diode may have an anode connected to a drain of the driving transistor M1 and a cathode connected to a ground power line for supplying a ground voltage ELVSS.

The driving transistor M1 may control the amount of current supplied from a first power line to a light-emitting element EL according to a pixel voltage VDATA. The first power line may supply a first power supply voltage ELVDD1. The pixel voltage VDATA may be used to determine a voltage written at, or stored in, capacitor CST, and may determine a gate-source voltage of the driving transistor M1. In pixel circuit 1, a voltage stored in capacitor CST may be a voltage that is substantially the same as the pixel voltage VDATA.

One end of capacitor CST may be connected to a second power line that supplies a second power supply voltage ELVDD2. The other end of capacitor CST may be connected to a gate of the driving transistor M1. The capacitor CST may hold a voltage corresponding to the pixel voltage VDATA.

The first switch transistor M2 may decide whether to transfer the pixel voltage VDATA from a data signal line (DATA) to capacitor CST. That is, in this embodiment, the first switch transistor M2 may be connected between a gate of the driving transistor M1 and the data signal line DATA. The first switch transistor M2 may be turned on or off by a first scan line signal SCANn (n being an integer indicating a number of a scan line). The first scan line signal SCANn may be output from a control circuit to be described below.

The second switch transistor M3 may determine a connection between the first power line supplied supplying the first power supply voltage ELVDD1 and a second power line supplying the second power supply voltage ELVDD2. The second switch transistor M3 may be turned on or off by a second scan line signal EMn. The second scan line signal EMn may be output from a control circuit to be described below.

In a display device according to the first embodiment, the first power line and the second power line may be disposed to be orthogonal. That is, the first power line may provide the first power supply voltage ELVDD1 to pixel circuits arranged in the same column. The second power line may provide the second power supply voltage ELVDD2 to pixel circuits arranged in the same row. Also, the first power supply voltage ELVDD1 and the second power supply voltage ELVDD2 may be the same voltage in some embodiments. That is, in a display device according to the first embodiment, it is possible to connect the first power line and the second power line through the second switch transistor M3. In other embodiments, ELVDD1 and ELVDD2 may be different.

Figure 2:
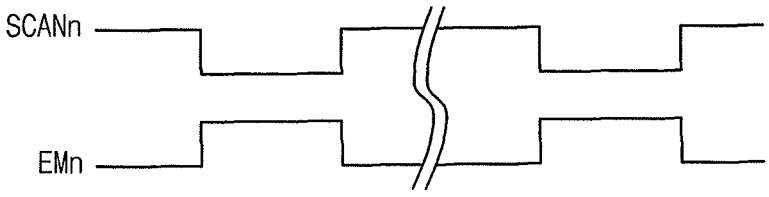
FIG. 2 illustrates an example of control signals for the pixel circuit.

A method for controlling the first switch transistor M2 and the second switch transistor M3 of the display device may be explained with reference to FIG. 2, which shows a timing diagram of control signals (e.g., the first scan line signal SCANn and the second scan line signal EMn) output from a control circuit. As illustrated in FIG. 2, in the display device according to the first embodiment, the first scan line signal SCANn and the second scan line signal EMn may be complementary to each other in terms of their logical levels. That is, the first switch transistor M2 and the second switch transistor M3 may be turned on exclusively from one another, e.g., during time periods which do not overlap.

Figure 3:
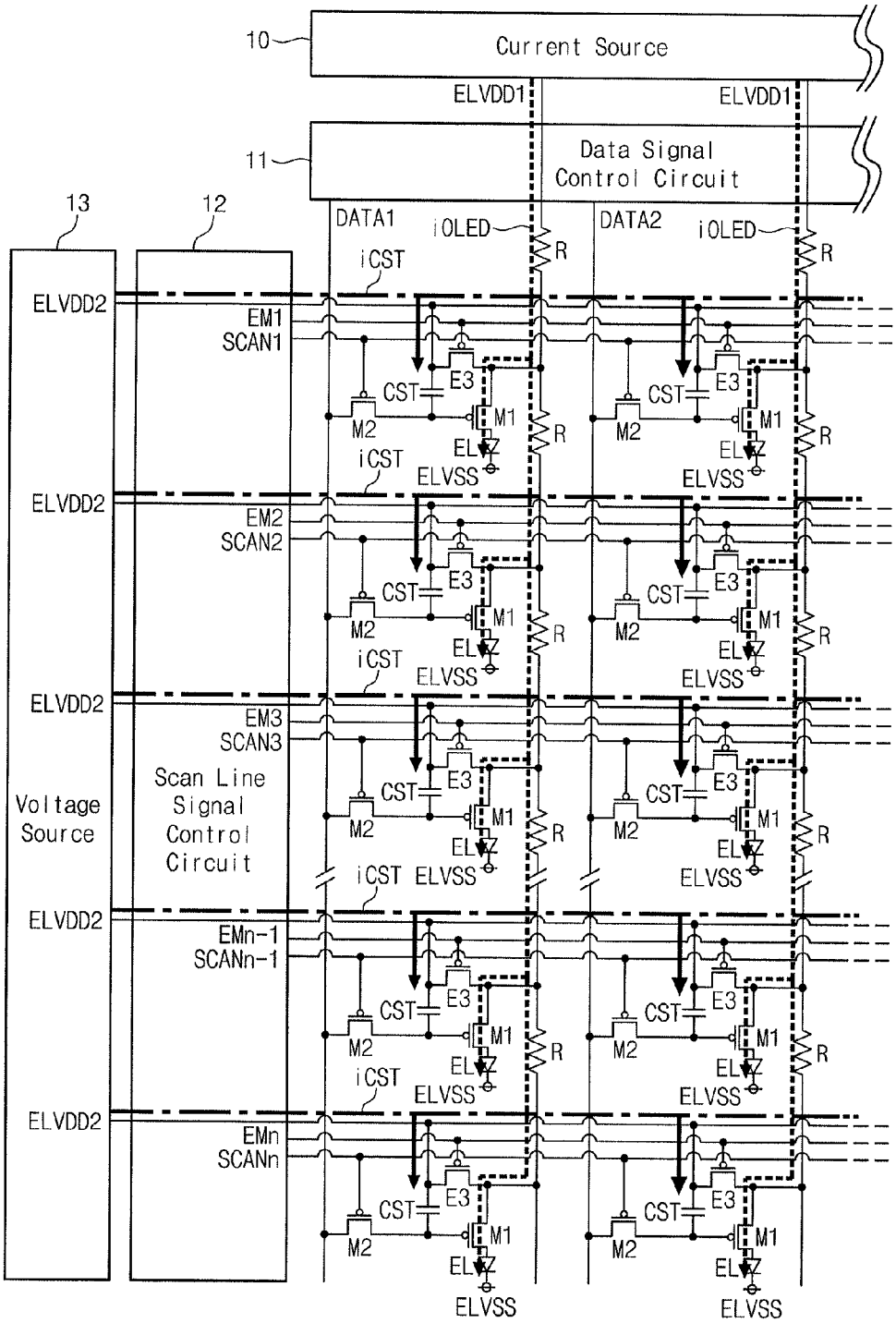
FIG. 3 illustrates a first embodiment of a display device.

FIG. 3 shows a first embodiment of a display device which includes pixel circuits disposed in a lattice shape. The pixel circuits may correspond to one in FIG. 1 or another embodiment described herein, or may, correspond to another type of pixel circuit. For illustrative purposes, the pixel circuits are shown as corresponding to FIG. 1

Each of the pixel circuits include a driving transistor M1, a light-emitting element EL, a capacitor CST, a first switch transistor M2, and a second switch transistor M3. Also, the display device may include a current source 10, a data signal control circuit 11, a scan line signal control circuit 12, and a voltage source 13 which constitute a control circuit for controlling pixel circuits.

The current source 10 may hold a voltage supplied to a first power line as a first power supply voltage ELVDD1, and may supply a driving current iOLED to a light-emitting element EL through a first power line. The first power line may be provided every column of pixel circuits. The current source 10 may supply the first power supply voltage ELVDD1 and the driving current iOLED every column. The first power line may have parasitic resistance R every interconnection length between the pixel circuits.

The data signal control circuit 11 may generate a data signal DATA having a pixel voltage VDATA of a voltage level corresponding to a data value provided from a control or other circuit. The data signal control circuit may determine a voltage to be stored by capacitor CST of a pixel circuit according to the data signal DATA.

The scan line signal control circuit 12 may sequentially activate a first row of pixel circuits to an nth row of pixel circuits according to a timing signal provided from a timing or control circuit. More particularly, the scan line signal control circuit 12 may sequentially output first scan line signals SCAN1 to SCANn and second scan line signals EM1 to EMn as control signals.

The scan line signal control circuit 12 may also perform a data update operation and a display operation. During a data update operation, in pixel circuits disposed along a first row to pixels disposed along an nth row, capacitor CST may be set up by a voltage corresponding to the pixel voltage VDATA. During the display operation, a light-emitting element EL may emit a light based on the pixel voltage VDATA.

The voltage source 13 may supply the second power supply voltage ELVDD2 to every pixel circuit in the same row. At this time, the voltage source 13 may output ELVDD2 to be the same voltage as the first power supply voltage ELVDD1. Also, the first power lines and the second power lines may be orthogonal to one another.

Also, the first power line may be disposed in the same direction as the data signal line. The first power supply voltage ELVDD1 may be provided to the driving transistor M1 of each pixel circuit through the first power line. The driving transistor M1 of each pixel circuit may be configured to always operate at a saturation region. The driving transistor may therefore act as a constant current source for supplying current based on the voltage stored by capacitor CST to the light-emitting element EL.

The second power line for transferring the second power supply voltage ELVDD2 may be formed in the same direction as a scan line. The second power line may supply the second power supply voltage ELVDD2, which may have the same voltage as the first power supply voltage ELVDD1, to capacitor CST of each pixel circuit.

The scan line signal control circuit 12 may sequentially select scan lines to activate a first scan line signal corresponding to a selected scan line. The first switch transistor M2 of each pixel circuit on a scan line supplied with the first scan line signal may be turned on. A voltage corresponding to a pixel voltage VDATA (e.g., gradation data) of a data signal DATA may be stored in the capacitor CST of each pixel circuit.

At this time, the second switch transistor M3 may be controlled by a second scan signal to be turned off. Therefore, during a data update period where the pixel voltage VDATA is written, the second power supply voltage ELVDD2 may be provided only to the capacitor CST. That is, the second power line for transferring the second power supply voltage ELVDD2 may not be connected to a light-emitting element EL that consumes the current iOLED. A current iCST supplied to the capacitor CST may flow to the second power line. Since the current iCST is much lower in level than the current iOLED flowing to the first power line, most of the second power supply voltage ELVDD2 transferred to the second power line may be transferred to pixel circuits located at far distances from the voltage source 13 without experiencing a voltage drop.

That is, in the display device according to the first embodiment, during the data update period, a voltage corresponding to the pixel voltage VDATA may be written at the capacitor CST based on the second power supply voltage ELVDD2, which has a voltage almost equal to a voltage of an output point of the current source 10.

Thus, in the display device of the first embodiment, a voltage having a small difference with the pixel voltage VDATA may be written at the capacitor CST of the pixel circuit regardless of a distance from the current source 10. Here, assuming that the first power supply voltage ELVDD1 and the second power supply voltage ELVDD2 are referred to as 'ELVDD', a potential VGATE of a gate terminal of the driving transistor M1 of each pixel circuit may be expressed by Equation (1).

$$VGATE \cong ELVDD - VOATA \quad (1)$$

If the first scan line signal is unselected after the end of the data update period, the first switch transistor M2 of each pixel circuit on a scan line may be turned off and a light-emitting element of each pixel circuit on the scan line may become at a light-emitting state. At this time, the second switch transistor M3 may be turned on and the first power line and the second power line may be shorted. In this case, although the first power supply voltage ELVDD1 is dropped, a gate-source voltage VGS of the driving transistor M1 may be almost equal to the pixel voltage VDATA. Here, when the light-emitting element EL is on a light-emitting state, the gate-source voltage VGS of the driving transistor M1 may be expressed by Equation (2).

$$VGS \cong VOATA \quad (2)$$

In the display device of the first embodiment, it is possible to display gradation where the driving transistor M1 reflects the pixel voltage VDATA with good accuracy and without influence of a voltage drop of the first power supply voltage ELVDD1.

Figure 4:
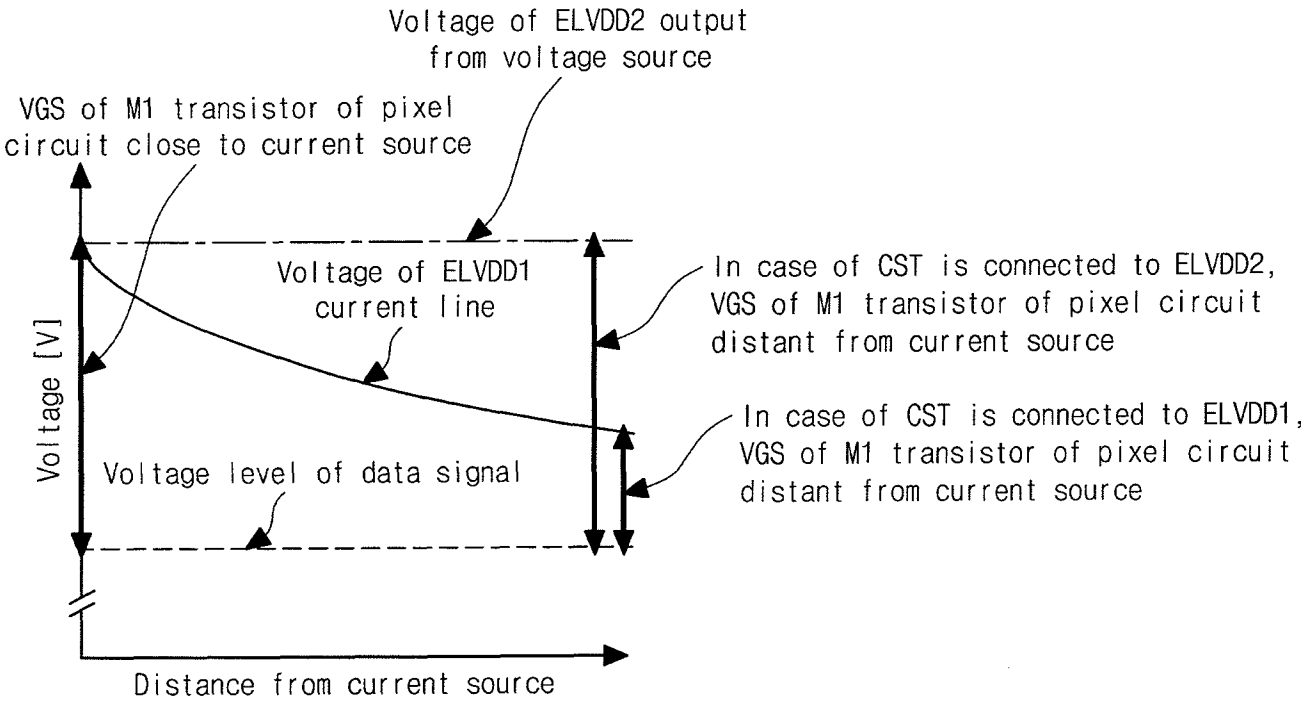
FIG. 4 illustrates a relationship between a distance from a current source and a gate-source voltage VGS of a driving transistor of a display device according to a first embodiment.

FIG. 4 is a graph indicating a relationship between a distance from a current source 10 and a gate-source voltage VGS of a driving transistor M1. As illustrated in FIG. 4, the longer a distance from a current source 10, the larger a voltage drop of a first power supply voltage ELVDD1. Meanwhile, a second power supply voltage ELVDD2 may maintain an almost constant level regardless of a distance from the current source 10. That is, in the first embodiment of the display device, it is possible to write a voltage having a small difference with the pixel voltage VDATA in capacitor CST of each pixel circuit regardless of a distance of the pixel circuit from the current source 10.

Figure 5:
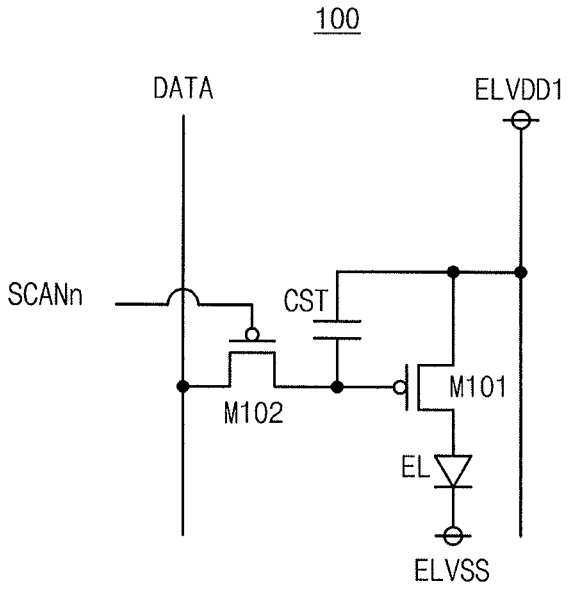
FIG. 5 illustrates one type of pixel circuit compared to a pixel circuit according to the first embodiment.

FIG. 5 shows a circuit diagram of another type of pixel circuit 100. As illustrated in FIG. 5, in pixel circuit 100, one terminal of capacitor CST and a source of a driving transistor M101 may be connected to a first power line supplied with a first power supply voltage ELVDD1. A light-emitting element EL may be connected between a drain of the driving transistor M101 and a ground terminal. The other terminal of capacitor CST and one terminal of a switch transistor M102 may be connected to a gate of the driving transistor M101. The other terminal of the switch transistor M102 is connected to a data signal line for transferring a data signal DATA.

That is, pixel circuit 100 is configured such that writing of a pixel voltage VDATA at capacitor CST is performed based on the first power supply voltage ELVDD1. Also, in pixel circuit 100, the light-emitting element EL may be driven based on the first power supply voltage ELVDD1.

Figure 6:
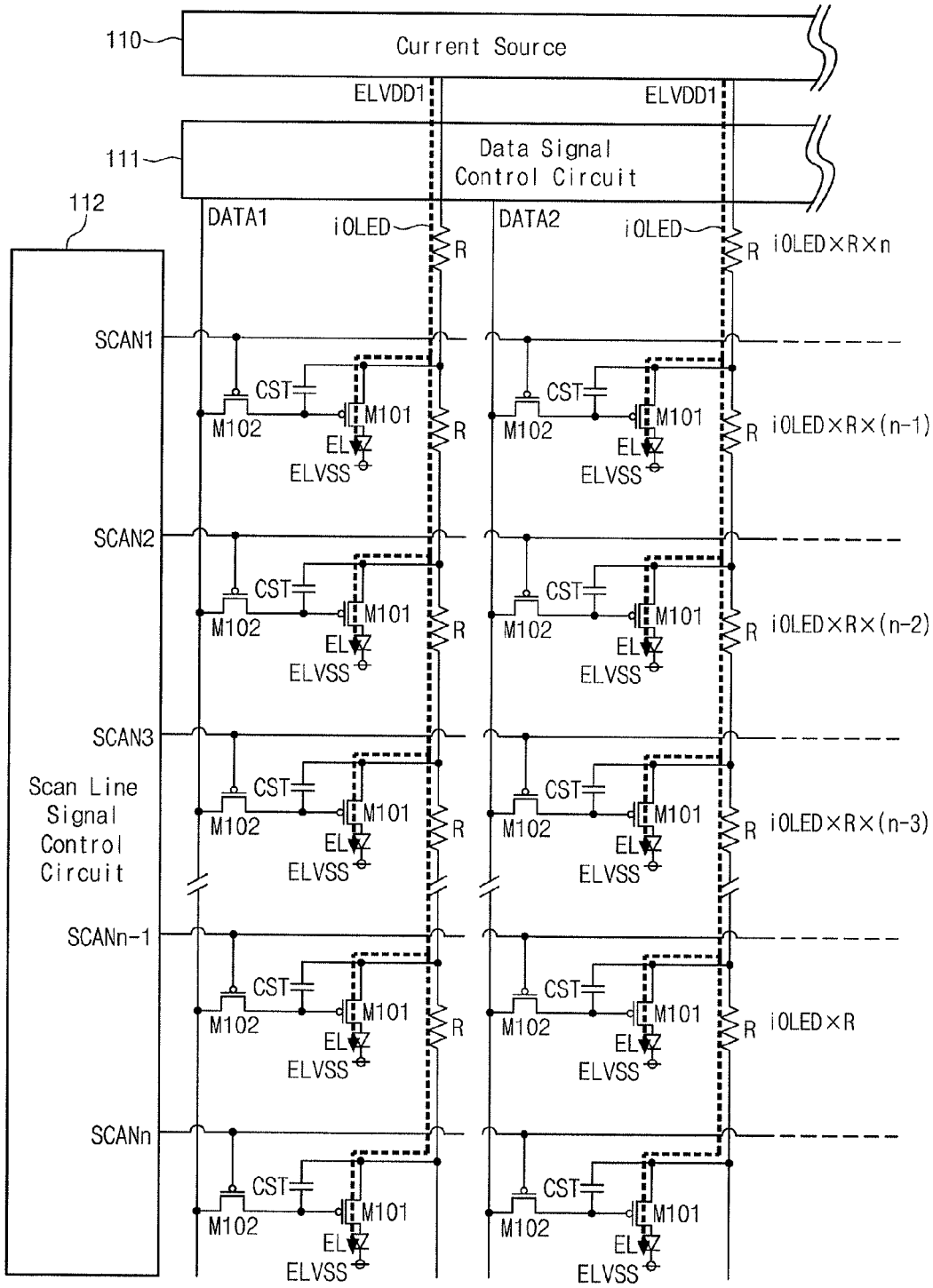
FIG. 6 illustrates one type of pixel circuit compared to a pixel circuit according to a first embodiment.

FIG. 6 illustrates a display device including pixel circuit 100. As illustrated in FIG. 6, the display device is configured such that the pixel circuits are disposed in a lattice shape. However, the display device does not include a voltage source 13 as included in the first embodiment of the display device. Also, current source 110 outputs a first power supply voltage ELVDD1, and a scan line signal control circuit 112 is configured to output only first scan line signals SCAN1 to SCANn. Pixel circuit 100, therefore, does not generate a second power supply voltage ELVDD2. As a result, the voltage from current source 110 may drop substantially according to a distance from the current source 110, as a result of parasitic resistance R of power lines connecting pixel circuits.

This voltage drop of the first power supply voltage ELVDD1 will now be more fully described. A power line for transferring the first power supply voltage ELVDD1 may be disposed along a data line direction. A driving transistor M1 of each pixel circuit may be configured to always operate at a saturation region. Thus, the driving transistor M! may act as a constant current source that supplies current according to a voltage level of a pixel voltage VDATA supplied to the light-emitting element EL. A current Ids flowing to the light-emitting element EL may be expressed by equation (3).

$$Ids = \frac{W}{L}\mu_n \times Cox\left[\frac{1}{2} \times (VGS - V_{th})^2\right] \tag{3}$$

In equation (3), W indicates a channel width of the driving transistor M101, L indicates a channel length of the driving transistor M101, $\mu_n$ indicates a carrier mobility, Cox indicates a gate capacity of the driving transistor M101 per unit area, VGS indicates a gate-source voltage of the driving transistor M101, and $V_{th}$ indicates a threshold voltage of the driving transistor M101.

In comparing the display device according to a first embodiment and the display device in FIG. 6, a gate-source voltage VGS of the driving transistor M101 may be maintained at a voltage determined by writing in capacitor CST a pixel voltage VDATA corresponding to a display gradation of each pixel circuit. A current Ids corresponding to the gate-source voltage VGS may be supplied to the light-emitting element EL through the driving transistor M101. The light-emitting element EL may emit light having a luminance of gradation corresponding to the supplied current Ids.

At this time, in the display device according to FIG. 6, a voltage level of the first power supply voltage ELVDD1 may drop as a result of parasitic resistance R. The drop that is experienced may be in proportion to the distance of the pixel circuit from current source 110. The voltage drop Vdrop may be expressed by equation (4).

$$Vdrop = \frac{iOLED \times R \times n \times (n+1)}{2} \tag{4}$$

In equation (4), iOLED indicates a current supplied to a light-emitting element EL that emits light by maximum emission luminance, R indicates parasitic resistance of a power line, and n indicates the number of pixels on a data signal line.

As understood from the equation (4), a drain-source voltage VDS of the driving transistor M101 of a pixel circuit that is far away from current source 110 will be smaller than a drain-source voltage VDS of a pixel circuit closer to current source 110. As a result, although the light-emitting elements originally have the same luminance, emission luminance of light-emitting elements may be different from one another.

In attempt to solve this problem of voltage drop, a technique of reducing resistance of a power line has been proposed. However, an increase in line resistance may be inevitable as display devices continue to require higher definition/higher resolution levels.

Also, a pixel circuit using a P-channel transistor may present different problem. For example, if a pixel voltage VDATA is written at capacitor CST based on a data signal transferred through a data signal line, a gate-source voltage VGS1 of driving transistor M101 in a pixel circuit (e.g., a pixel circuit connected to a scan line signal of a first row) close to the current source 110 may be expressed by equation (5).

$$VGS1 \approx ELVDD - VDATA \tag{5}$$

A gate-source voltage VGSn of a driving transistor M101 of a pixel circuit (e.g., a pixel circuit connected to a scan line signal of an nth row) farther away from current source 110 may be expressed by equation (6).

$$VGSn \approx ELVOD - VDATA - Vdrop \tag{6}$$

It is impossible to solve a gate-source voltage difference expressed by the equations (5) and (6) by changing the widths and or thicknesses of supply and signal lines, as has also been proposed. However, this problem may be solved in accordance with the embodiments described herein.

In a display device according to the first embodiment, pixel circuit 1 writes a pixel voltage VDATA at capacitor CST based on a second power supply voltage ELVDD2 during a data update period. As a result, the display device according to the first embodiment may write a voltage in capacitor CST which has effectively no difference in pixel voltage VDATA of a data signal.

Also, in the display device according to the first embodiment, during a light-emitting period a first power line supplying first power supply voltage ELVDD1 to pixel circuit 1 and a second power line supplying second power supply voltage ELVDD2 to pixel circuit 1 may be connected through a second switch transistor M3. As a result, any voltage drop experienced by the first power supply voltage ELVDD1 during the light-emitting period may be compensated for by the second power supply voltage ELVDD2. Also, a voltage difference between the drain and source of driving transistor M1, which results from the distance of the pixel circuit from a current source 10, may be reduced.

Thus, the display device according to the first embodiment may solve a luminance difference of a light-emitting element EL by compensating for a difference in pixel voltages VDATA and a voltage difference between the drain and source of driving transistor M1, regardless of distance from the current source 10.

Figure 7:
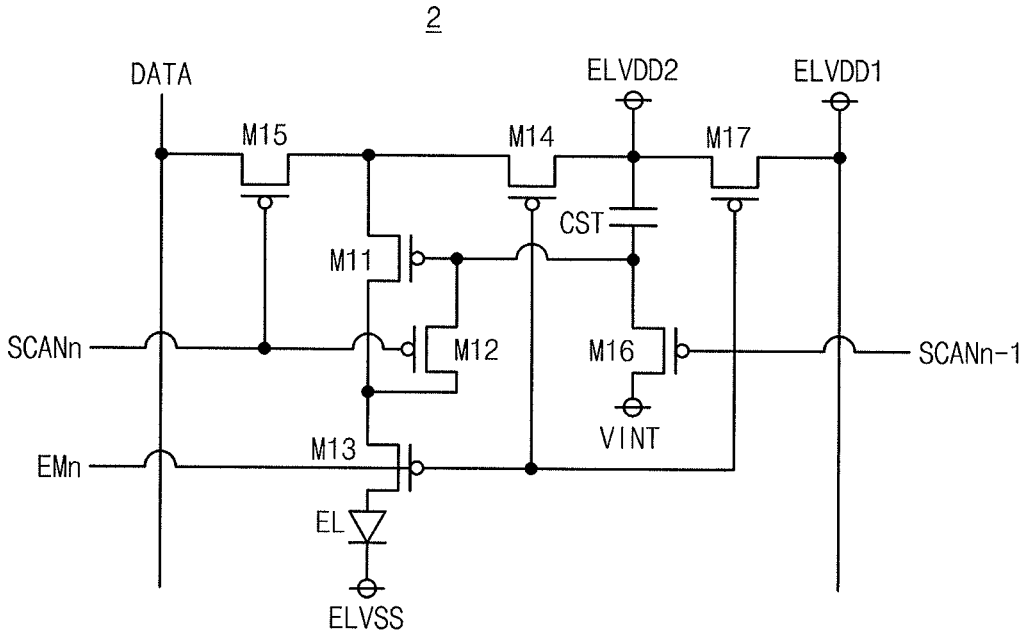
FIG. 7 illustrates a second embodiment of a pixel circuit.

FIG. 7 illustrates a pixel circuit 2 having a circuit shape different from that shown in FIG. 1. As illustrated in FIG. 7, a pixel circuit 2 according to a second embodiment may include a driving transistor M11, a light-emitting element EL, a first switch transistor M15, a second switch transistor M17, a third switch transistor M12, an emission transistor M13, a fourth switch transistor M14, and a fifth switch transistor M16.

The light-emitting element EL may be a light-emitting diode, for example. The light-emitting diode may have an anode connected to a drain of the driving transistor M11 and a cathode connected to a ground power line for supplying a ground voltage ELVSS.

The driving transistor M11 may control the amount of current supplied from a first power line (through which a first power supply voltage ELVDD1 is supplied) to a light-emitting element EL according to a pixel voltage VDATA. The pixel voltage VDATA may be used to determine a voltage written in capacitor CST, and may determine a gate-source voltage of the driving transistor M11. In pixel circuit 2, a voltage written at capacitor CST may be expressed as (VDATA-|Vth|).

One end of capacitor CST may be connected to a second power line to which a second power supply voltage ELVDD2 is supplied. The other end of capacitor CST may be connected to a gate of the driving transistor M11. The capacitor CST may hold a voltage corresponding to the pixel voltage VDATA.

The first switch transistor M15 may determine whether to transfer the pixel voltage VDATA from a data signal line carrying data signal DATA to capacitor CST. More particularly, the first switch transistor M15 may be connected between a gate of the driving transistor M11 and a data signal line for transferring the data signal DATA.

The third switch transistor M12 may be controlled by the same control signal as first switch transistor M15, and may be connected between the gate and drain of the driving transistor M11. Also, the first switch transistor M15 and the third switch transistor M12 may be turned on or off by a first scan line signal SCANn (n being an integer indicating a number of a scan line).

In the event first switch transistor M15 and third switch transistor M12 are turned on together, the driving transistor M11 may be diode connected. A voltage (e.g., VDATA-|Vth|) corresponding to pixel voltage VDATA transferred to a data signal line may be provided to a terminal at a side of the driving transistor M11. The first scan line signal SCANn may be output from a control circuit, to be described below.

The second switch transistor M17 may determine a connection between a first power line supplied with the first power supply voltage ELVDD1 and a second power line supplied with the second power supply voltage ELVDD2. The second switch transistor M17 may be turned on or off by a second scan line signal EMn. The second scan line signal EMn may be output from a control circuit, to be described below.

The emission transistor M13 may be controlled by the same control signal as the second switch transistor M17. The emission transistor M13 may be connected between a drain of the driving transistor M11 and the light-emitting element EL.

The fourth switch transistor M14 may be controlled by the same control signal as the second switch transistor M17. The fourth switch transistor M14 may be connected between the source of driving transistor M11 and the second power line.

The fifth switch transistor M16 may provide capacitor CST with an initialization voltage VINT during a period before a pixel voltage of a data signal is supplied to capacitor CST through the first switch transistor M15.

Like the display device according to a first embodiment, in the second embodiment of the display device, the first power line and the second power line may be disposed to be orthogonal to one another. Also, the first power supply voltage ELVDD1 and the second power supply voltage ELVDD2 may have the same voltage.

Figure 8:
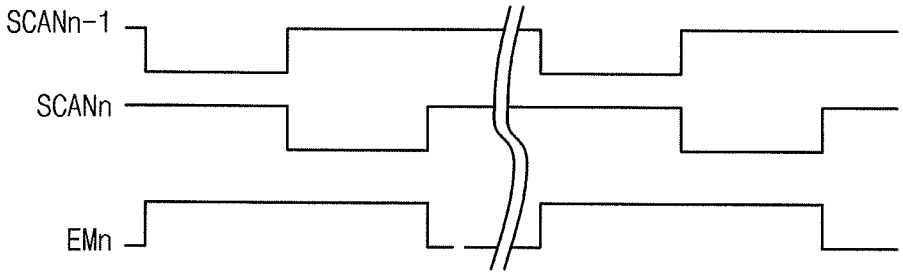
FIG. 8 illustrates control signals for the second embodiment of the pixel circuit.

FIG. 8 illustrates a timing diagram of control signals (e.g., first scan line signals SCANn and SCANn-1 and a second scan line signal EMn) output from a control circuit to control pixel circuit 2. As illustrated in FIG. 8, the first scan line signal SCANn-1 may be a scan line signal provided to a pixel circuit connected to a scan line at a position before first scan line signal SCANn. Thus, a low-level period of the first scan line signal SCANn-1 may precede that of the first scan line signal SCANn.

In pixel circuit 2 shown in FIG. 7, while the first scan line signal SCANn-1 is at a low level, the first scan line signal SCANn and the second scan line signal EMn are at a high level. Therefore, as fifth switch transistor M16 is turned on by the low level of first scan line signal SCANn-1, a voltage to be held by capacitor CST may become an initialization voltage VINT. In this case, a driving transistor M11 may be turned on.

After the first scan line signal SCANn-1 transitions from a low level to a high level, the first scan line signal SCANn may transition from a high level to a low level. On the other hand, the second scan line signal EMn may maintain a high level. As a result, a display device according to a second embodiment may write an image voltage VDATA at capacitor CST through first switch transistor M15, driving transistor M11, and third switch transistor M12. If a gate-source voltage VGS of driving transistor M11 becomes a threshold voltage Vth of driving transistor M11, the driving transistor M11 may be turned off and capacitor CST may hold a voltage (e.g., VDATA-|Vth|) corresponding to the image voltage VDATA.

In the display device according to the second embodiment, capacitor CST may be reset by the initialization voltage VINT. Then, switch transistors M15 and M12 and switch transistors M17, M13, and M14 may be exclusively turned on. Like the first embodiment, the display device according to the second embodiment may write a pixel voltage VDATA only on the basis of the second power supply voltage ELVDD2 during a data update period.

In the display device according to the second embodiment, the first scan line signal SCANn may transition to a high level, and simultaneously the second scan line signal EMn may transition to a low level. In this case, a first power line supplying a first power supply voltage ELVDD1 and a second power line supplying a second power supply voltage ELVDD2 may be connected. Also, the first power supply voltage ELVDD1 and the second power supply voltage ELVDD2 may be supplied to one terminal of the capacitor CST and a source of the driving transistor M11, and the driving transistor M11 may act as a constant current source based on a voltage corresponding to pixel voltage VDATA. As a result, light-emitting element EL may emit light.

Figure 9:
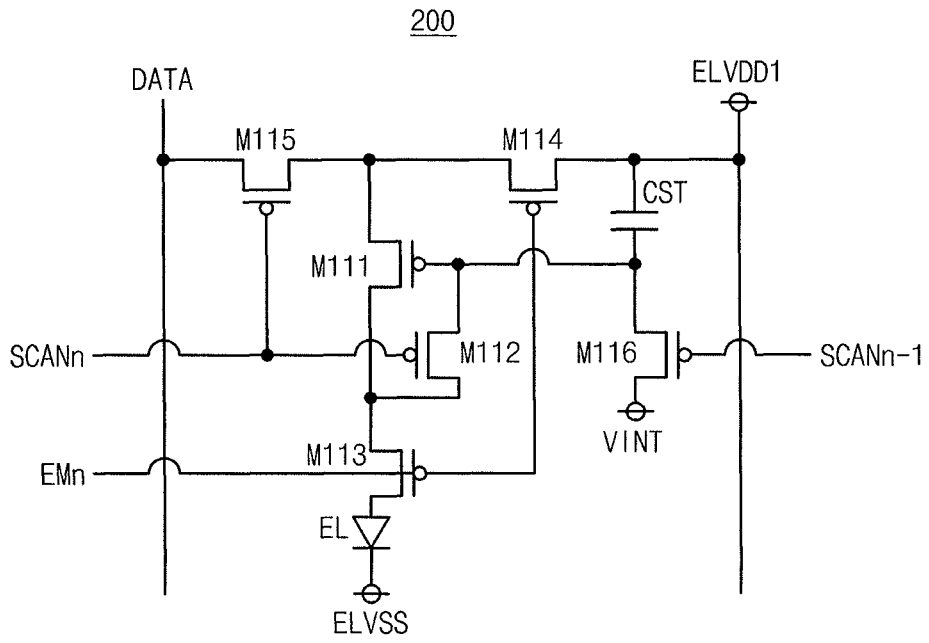
FIG. 9 illustrates one type of pixel circuit compared to the pixel circuit of the second embodiment.

FIG. 9 shows a pixel circuit 200 which does not use second switch transistor M17. Referring to FIG. 9, pixel circuit 200 includes transistors M111 to M116 that respectively correspond to transistors M11 to M16. However, in pixel circuit 200, a first power supply voltage ELVDD1 is directly supplied to capacitor CST and one terminal of the transistor M114. Also, the pixel circuit 200 does not use a second power supply voltage ELVDD2 as in the aforementioned embodiments.

That is, in pixel circuit 200, writing a pixel voltage VDATA at capacitor CST and driving a light-emitting element EL is performed based on a first power supply voltage ELVDD1, which produces a voltage drop with distance. More specifically, in a display device using pixel circuit 200, as the location of a pixel circuit becomes farther away from a current source 10, a difference between pixel voltages and a voltage difference between the source and drain of driving transistor Mill may increase due to a voltage drop of the first power supply voltage ELVDD1.

The pixel circuit 2 overcomes this problem by writing pixel voltage VDATA only on the basis of a second power supply voltage ELVDD2 during a data update period. Also, the first power supply voltage ELVDD1 and the second power supply voltage ELVDD2 are supplied to driving transistor M11 during a light-emitting period. As a result, a display device using pixel circuit 2 may reduce a difference between pixel voltages and a voltage difference between the source and drain of the driving transistor M11.

Thus, pixel circuit 2 according to the second embodiment may compensate for threshold voltage differences of the driving transistor M11 by diode-connecting the driving transistor M11 and providing a pixel voltage to capacitor CST through a third switch transistor M12 when writing a pixel voltage VDATA.

Figure 10:
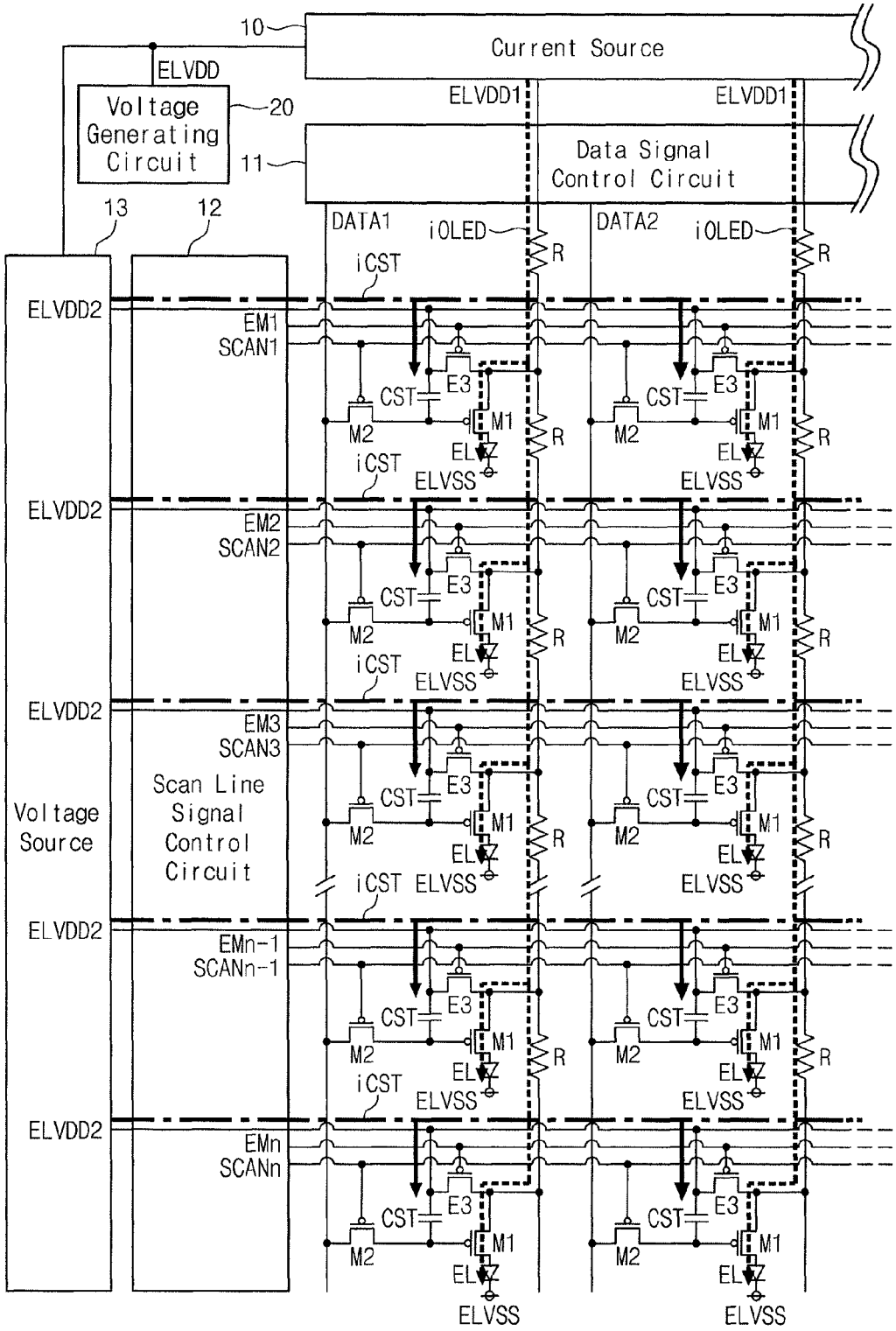
FIG. 10 illustrates a block diagram of a display device according to a first embodiment.

FIG. 10 illustrates a display device according to a third embodiment which includes a voltage generating circuit 20. The voltage generating circuit 20 may generate a power supply voltage ELVDD for input into current source 10 and voltage source 13. The current source 10 may provide the power supply voltage ELVDD generated by the voltage generating circuit 20 to a first power line for every column. The voltage source 13 may provide the power supply voltage ELVDD generated by the voltage generating circuit 20 to a second power line for every row. The display device according to a third embodiment may distribute the power supply voltage ELVDD generated by the voltage generating circuit 20, such that the first power supply voltage ELVDD1 and the second power supply voltage ELVDD2 are provided to the pixel circuits.

The first power supply voltage ELVDD1 and the second power supply voltage ELVDD2 may have the same voltage, by distributing power supply voltage ELVDD to generate the first power supply voltage ELVDD1 and the second power supply voltage ELVDD2. Also, although a first power line and a second power line are connected through a second switch transistor M3, no problem may be generated.

By way of summation and review, the longer a distance between a power supply source and a pixel circuit, the larger a voltage drop of a power supply line. In case of a display device where the number of pixels increases and an image becomes more detailed, a width of a power line connected to the driving transistor may become narrower, and a difference of voltage drops of power lines of pixel circuits may become larger. Therefore, in a recent display device, a difference between pixel voltages may be generated by such voltage drops. This may cause a luminance difference. When influence of voltage drops of power lines is not removed using a period where a pixel voltage is charged and retained, a difference between pixel voltages may not be solved.

In contrast, in accordance with one or more embodiments, a voltage drop of a power line may be reduced or prevented by writing a pixel voltage VDATA only on the basis of the second power supply voltage ELVDD2 during a data update period. The first and second power lines may be separated during a period where the capacitor is charged by the pixel voltage, and shorted during a period where the driving transistor operates according to the pixel voltage. Further, according to one or more embodiments, a voltage drop of a power line may be reduced or prevented due to connection of the first power line and the second power line, by distributing the power supply voltage ELVDD (generated by the voltage generating circuit 20) to generate the first power supply voltage ELVDD1 and the second power supply voltage ELVDD2.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A pixel circuit, comprising:

a light-emitting element;

a driving transistor to control an amount of current supplied from a first power line to the light-emitting element according to a pixel voltage;

a capacitor to hold the pixel voltage, the capacitor having one end connected to a second power line and another end connected to a gate of the driving transistor;

a first switch transistor to supply the pixel voltage provided through a data signal line to the capacitor when the first switch transistor is turned on by a first control signal; and a second switch transistor to electrically connect the first power line and the second power line when the second switch transistor is turned on by a second control signal, wherein the first and second switch transistors are turned on at different times which do not overlap one another, and wherein an end of the first control signal synchronizes with a start of the second control signal.

2. The pixel circuit as claimed in claim 1, wherein voltages transferred through the first and second power lines have substantially a same voltage value.

3. The pixel circuit as claimed in claim 2, further comprising:

a voltage generator to generate the voltages transferred through the first and second power lines.

4. The pixel circuit as claimed in claim 1, wherein the first and second power lines intersect one another.

5. The pixel circuit of one as claimed in claim 4, wherein the first switch transistor is connected between the data signal line and the gate of the driving transistor.

6. The pixel circuit of one as claimed in claim 4, further comprising:

a third switch transistor controlled by the first control signal, the third switch transistor connected between the gate and a drain of the driving transistor;

an emission transistor controlled by the second control signal, the emission transistor connected between the drain of the driving transistor and the light-emitting element;

a fourth switch transistor controlled by the second control signal, the fourth switch transistor connected between a source of the driving transistor and the second power line; and a fifth switch transistor to provide the capacitor with an initialization voltage during a period before when the pixel voltage is supplied to the capacitor by the first switch transistor, wherein the first switch transistor is connected between the data signal line and the source of the driving transistor.

7. A display device, comprising:

a plurality of pixel circuits arranged in a lattice shape; and a control circuit to control the plurality of pixel circuits by first and second control signals, wherein each of the plurality of pixel circuits comprises:

a light-emitting element;

a driving transistor to control an amount of current supplied from a first power line to the light-emitting element according to a pixel voltage;

a capacitor to hold the pixel voltage, the capacitor having one end connected to a second power line and another end connected to a gate of the driving transistor;

a first switch transistor to supply the pixel voltage provided through a data signal line to the capacitor when the first switch transistor is turned on by the first control signal; and a second switch transistor to electrically connect the first power line and the second power line when the second switch transistor is turned on by the second control signal, wherein the control circuit is further configured to turn on the first and second switch transistors at different times which do not overlap one another, and wherein an end of the first control signal synchronizes with a start of the second control signal.

8. The display device as claimed in claim 7, wherein voltages transferred through the first and second power lines have substantially a same voltage value.

9. The display device as claimed in claim 8, further comprising:

a voltage generator to generate the voltages transferred through the first and second power lines.

10. The display device as claimed in claim 8, wherein the first and second power lines intersect one another.

11. The display device as claimed in claim 10, wherein the first switch transistor is connected between the data signal line and the gate of the driving transistor.

12. The display device as claimed in claim 10, wherein each of the plurality of pixel circuits further comprises:

a third switch transistor controlled by the first control signal, the third switch transistor connected between the gate and a drain of the driving transistor;

an emission transistor controlled by the second control signal, the emission transistor connected between the drain of the driving transistor and the light-emitting element;

a fourth switch transistor controlled by the second control signal, the fourth switch transistor connected between a source of the driving transistor and the second power line; and a fifth switch transistor to provide the capacitor with an initialization voltage during a period before when the pixel voltage is supplied to the capacitor by the first switch transistor, wherein the first switch transistor is connected between the data signal line and the source of the driving transistor.

13. A pixel circuit, comprising:

a capacitor coupled to a second power supply, the capacitor to store a data voltage;

a driving transistor coupled to the capacitor; and a light-emitting element coupled to the driving transistor, wherein:

the capacitor is electrically coupled to a data line through a first switch being turned on by a first control signal during a first period and the light-emitting element is coupled to a signal path which electrically couples the second power supply to a first power supply through a second switch being turned on by a second control signal during a second period, wherein the signal path is coupled to the light-emitting element through the driving transistor during the second period, and wherein an end of the first control signal synchronizes with a start of the second control signal.

14. The pixel circuit as claimed in claim 13, wherein the first and second power supplies supply substantially a same voltage.

15. The pixel circuit as claimed in claim 13, wherein:

a data update operation is performed during the first period, and a light-emitting operation is performed during the second period.

16. The pixel circuit as claimed in claim 13, wherein the second power supply is not coupled to the light-emitting element during the first period.

17. The pixel circuit as claimed in claim 13, wherein a gate-source voltage of the driving transistor is substantially equal to the data voltage stored in the capacitor during the second period based on supply of voltage from the second power supply.

18. The pixel circuit as claimed in claim 13, wherein:

the second power supply is prevented from being coupled to the light-emitting element by a turn-off signal of the second control signal; and the second power supply is coupled to the first power supply through the signal path by a turn-on signal of the first control signal complementary to the first control signal.

19. The pixel circuit as claimed in claim 13, wherein the first switch is coupled to the signal path between the first and second power supply; and the second switch is coupled between the data line and a node of the capacitor, and wherein the first and second switches have different on/off states during the first and second periods.

20. The pixel circuit as claimed in claim 13, further comprising:

a first line coupled to the first power supply; and a second line coupled to the second power supply, wherein the first and second lines are oriented in different directions that cross one another.

* * * * *